United States Patent [19]

Asher

[11] 4,349,708

[45] Sep. 14, 1982

[54] JOYSTICK CONTROL

[75] Inventor: James C. Asher, San Jose, Calif.

[73] Assignee: Atari, Inc., Sunnyvale, Calif.

[21] Appl. No.: 69,015

[22] Filed: Aug. 22, 1979

[51] Int. Cl.[3] ..... H01H 25/04

[52] U.S. Cl. ..... 200/6 A; 200/17 R; 200/153 K; 74/471 XY

[58] Field of Search ..... 200/5 A, 6 A, 17 R, 200/153 K; 74/471 XY

[56] References Cited

U.S. PATENT DOCUMENTS

| | | | |
|---|---|---|---|
| 2,941,048 | 6/1960 | Lybrook et al. | 200/6 A |
| 3,725,907 | 4/1973 | Boulanger | 200/5 A X |
| 3,772,484 | 11/1973 | Roeser | 200/6 A X |
| 3,796,843 | 3/1974 | Durkee et al. | 200/5 A |
| 3,898,397 | 8/1975 | Devore et al. | 200/6 A |
| 3,941,964 | 3/1976 | Yoder | 200/5 A X |
| 4,029,915 | 6/1977 | Ojima | 200/6 A X |
| 4,071,718 | 1/1978 | Harden | 200/5 A |
| 4,124,787 | 11/1978 | Aamoth et al. | 200/6 A |

*Primary Examiner*—James R. Scott

*Attorney, Agent, or Firm*—Townsend and Townsend

[57] ABSTRACT

A joystick controller in which a conventional handle is moveable radially with respect to its axis relative to an axial pivot location from the nominal rest position of the handle is disclosed. A plurality of pressure-actuated switches are disposed in a common plane normal to the axis of the handle in its rest position. The switches circumscribe the approximate pivot location of the handle. A deformable resilient annular member is superimposed over the switches. The annular member is fixed to the handle so that displacement of the handle from its rest position causes an arcuate portion of the annular member to press against at least one of the switches. The annular member thus actuates selected switches depending on the direction in which the handle is displaced by the operator.

18 Claims, 6 Drawing Figures

JOYSTICK CONTROL

BACKGROUND OF THE INVENTION

The present invention relates to a joystick controller, and in particular to such a controller which selectively closes various switches to control the movement of a character in a game.

Joystick controllers are used in various applications, one of which is the control of the movement of figures or objects in a video game. Such video games are generally used in a home environment, and the joystick controllers must therefore be highly reliable, resistant to damage through abuse, inexpensive and easy to operate. The latter factor is a particular concern in video games because such games are often used by children who are unable to operate controllers with facility if excessive stick forces are required.

U.S. Pat. No. 4,124,787 depicts a joystick controller adapted for use in a video game. The stick forces provided by this controller are quite light and well within the capability of even young children. However, to achieve such light stick forces, the manner in which the switches are actuated is relatively complicated and involves many parts, including both metal springs and plastic springs. Accordingly, such joysticks have been found to be prone to defects in the assembly process, failure in the home environment, and are relatively expensive to construct.

SUMMARY OF THE INVENTION

The present invention provides a joystick controller in which a conventional handle is moveable radially with respect to its axis relative to an axial pivot location from the nominal rest position of the handle. A plurality of pressure-actuated switches are disposed in a common plane normal to the axis of the handle in its rest position. The switches circumscribe the approximate pivot location of the handle. A deformable resilient annular member is superimposed over the switches. The annular member is fixed to the handle so that displacement of the handle from its rest position causes an arcuate portion of the annular member to press against at least one of the switches. The annular member thus actuates selected switches depending on the direction in which the handle is displaced by the operator.

The present invention is of relatively straight-forward construction, and avoids the necessity of both wire springs and plastic springs to actuate the switches. Instead, the present invention relies on a simple unitary resilient member to provide all of the spring action necessary. The controller of the present invention is thus far more reliable from a construction standpoint and a use standpoint, as well as being less expensive to construct, than prior controllers. However, the present invention still retains the low stick forces of the controller found in the above-referenced patent so that the device can readily be used in a home environment.

It is preferred that the resilient annular member be constructed of polypropylene material, and that it be attached to the handle at spaced locations intermediate the various switches which it is to activate. Since polypropylene has a poor "memory" and does not always tend to return to its original configuration when forces are eliminated, studs are provided above the member to bias it back to its original configuration when the handle is moved in the opposite direction. A resilient boot is fastened to the handle to maintain it in its nominal centered position when it is not being manually actuated.

The novel features which are characteristic of the invention, as to organization and method of operation, together with further objects and advantages thereof will be better understood from the following description considered in connection with the accompanying drawings which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
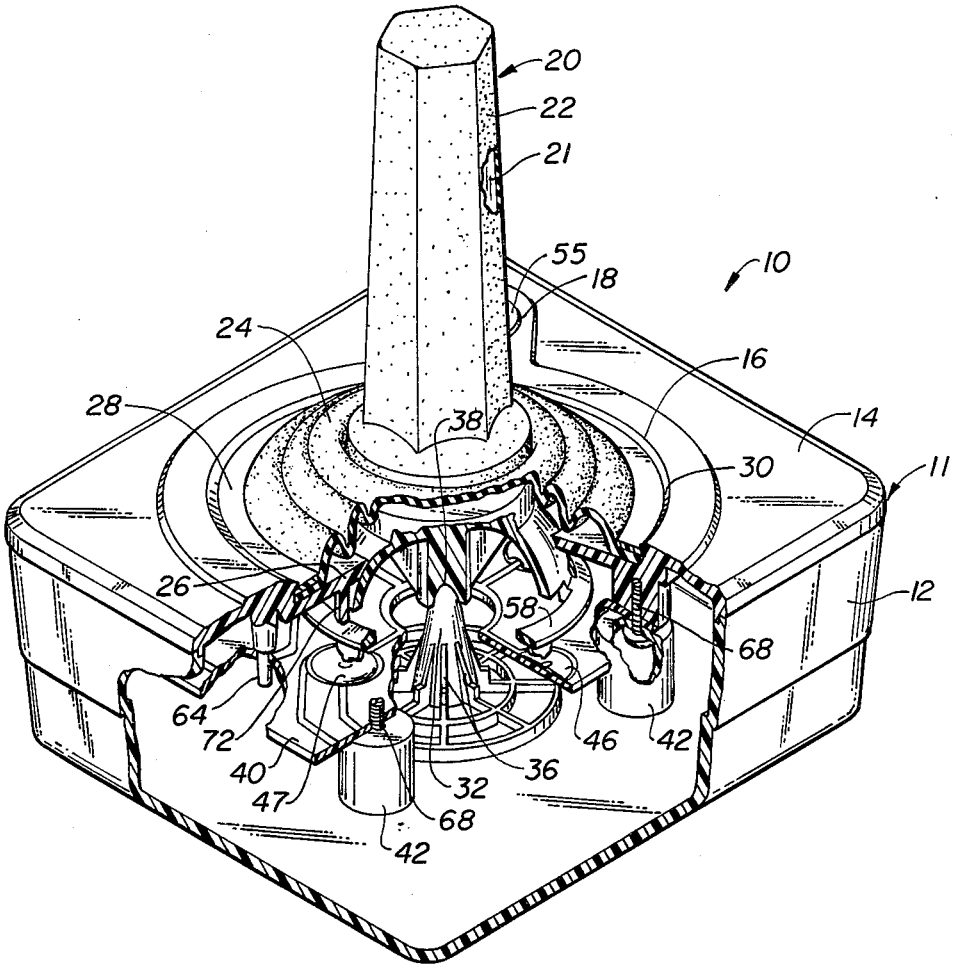
FIG. 1 is a partially cut away perspective view of the joystick controller of the present invention.
Figure 2:
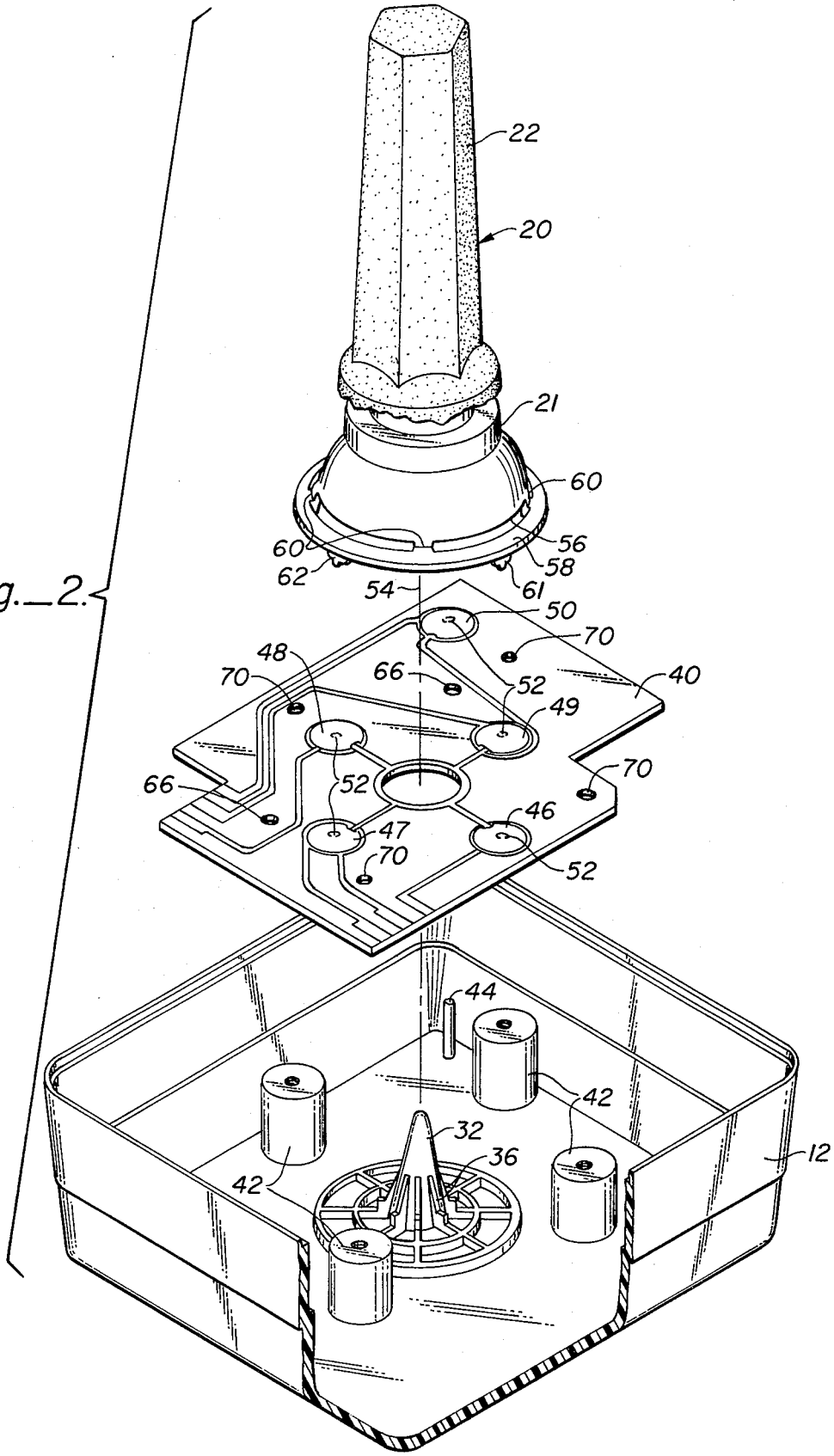
FIG. 2 is an exploded, partially cut away view of certain elements of the joystick controller of FIG. 1.

The preferred embodiment 10 of the joystick controller of the present invention is illustrated generally by way of reference to FIGS. 1 and 2 in combination. Joystick controller 10 includes a housing 11 defined by an upwardly opening base 12 and a cover plate 14. Cover plate 14 has a large centrally located aperture 16, together with a smaller aperture 8 offset to one side.

A handle 20 projects upwardly through the major opening 16 in controller 10. Handle 20 includes a central shaft 21 enclosed within a sheath 22. A resilient boot 24 is integral with sheath 22. The outer periphery of boot 24 fits within a recess defined by a ledge 26 circumscribing aperture 16. A retainer ring 28 snaps into engagement with an overhanging lip 30 so that the outer periphery of boot 24 is confined at the top surface of housing 11.

A support post 32 is integrally molded into the base 12 of housing 11, and includes a plurality of ridges 36 for structural rigidity. Handle 20 has a cup shaped receptacle 38 at its lower end, which is engaged by the upper end of support post 32. Handle 20 can be moved pivotally about its connection with support post 32 so that it is moveable radially relative to its axis from its nominal centered position. Resilient boot 24 maintains handle 20 in its nominal centered position until it is actuated, and returns it to its centered position after it has been actuated and released.

A substrate 40 is located within housing 11, and rests upon support posts 42 integrally molded in base 12. An auxiliary support peg 44 is also provided to support substrate 40. Support posts 32 and support peg 34 are located under switches 46–50 mounted to the substrate. Switches 46–50 are each pressure actuated dome switches, which are closed by pressing the exposed dome in a downward direction. Each switch 46–50 has a small central depression 52 to facilitate actuation, as will be discussed in more detail hereinafter. Switches 46–49 are orthogonally distributed about the axis of handle 20 in its nominal centered position, which is depicted by line 54, and switch 50 is located beneath firing button 55.

The precise position of substrate 40 is maintained by tapered projections 64 which project through and engage corresponding apertures 66 in the substrate. Screws 68 pass through apertures 70 in the substrate and connect base 12 to plate 14 to form housing 11.

Handle 20 includes a circular outer skirt portion 56. An annular member 58 is attached to the circular skirt 56 of handle 20 at spaced apart locations 60, which are located between the respective switches 46–49. Depending projections such as 61, 62, each having a pointed tip, are disposed immediately above each switch 46–49. Studs 72 depend from ledge 26 to a position immediately above annular member 58 above each of the switches 46–49.

Figure 3A:
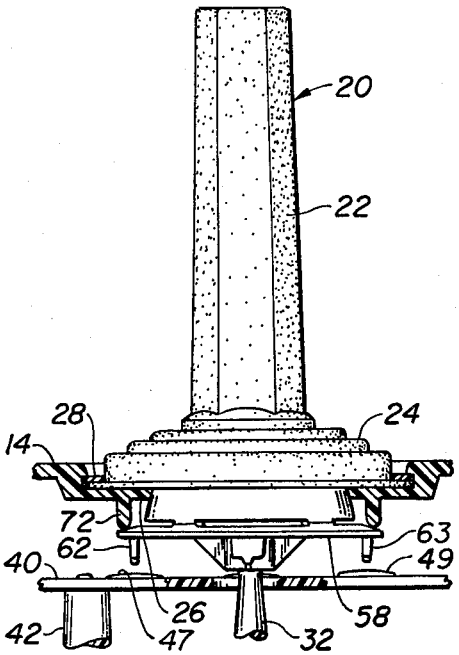
FIGS. 3A and 3B are fragmentary sectional views illustrating the operation of the joystick controller.
Figure 3B:
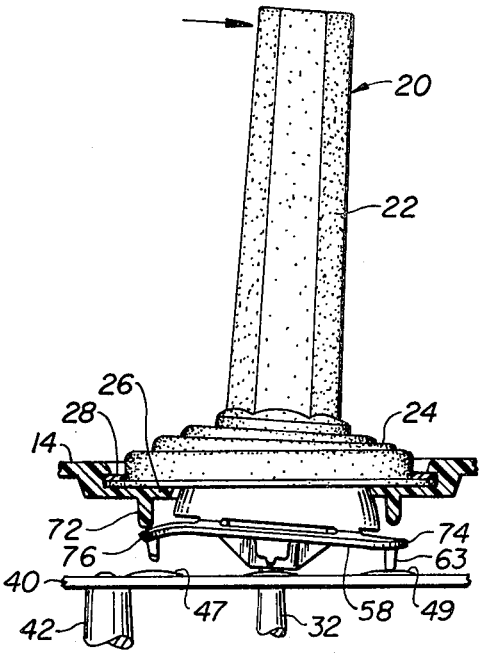

The operation of handle 20 in closing switches 46–49 is illustrated in more detail by way of reference to FIGS. 3A and 3B. In FIG. 3A, handle 20 is maintained in its nominal center position by boot 24. The projections 62, 63 overlying switches 47, 49 are spaced somewhat from the switches so that no pressure is exerted on the switches to close them.

When handle 20 is manually displaced as illustrated in FIG. 3B, an arcuate portion 74 of annular member 58 and its included depending projection 63 are pressed downwardly against switch 49. The sharp points and the end of projection 63 engages the recess 52 (not visible in FIG. 3B) to assure that the switch is closed. Annular member 58 is resilient and deforms as illustrated in FIG. 3B upon closure of the switch.

When handle 20 is displaced directly toward one of the switches, such as switch 49 in FIG. 3B, that switch alone will be closed. However, handle 20 can be displaced in directions between two of the switches, resulting in closure of two switches simultaneously. However, when 4 orthogonally distributed switches are used as in the present invention, no more than 2 switches can be closed at any one time.

Annular member 58 is preferably constructed of polypropylene material and is formed as part of shaft 21. Polypropylene is somewhat resilient, if sufficiently thin, but tends to have a poor "memory", i.e., after continuous usage it does not always return to its original configuration when stress is removed. Accordingly, when handle 20 is displaced as in FIG. 3B, the arcuate portion 76 of annular member 58 is pressed downwardly by stud 72. This downward deformation compensates for corresponding upward deformation where arcuate portion 76 is deformed upwardly upon actuation of its associated switch 47. Over the lifetime of the unit the number of upward and downward deformations will even out and member 58 will retain its original shape.

Figure 4:
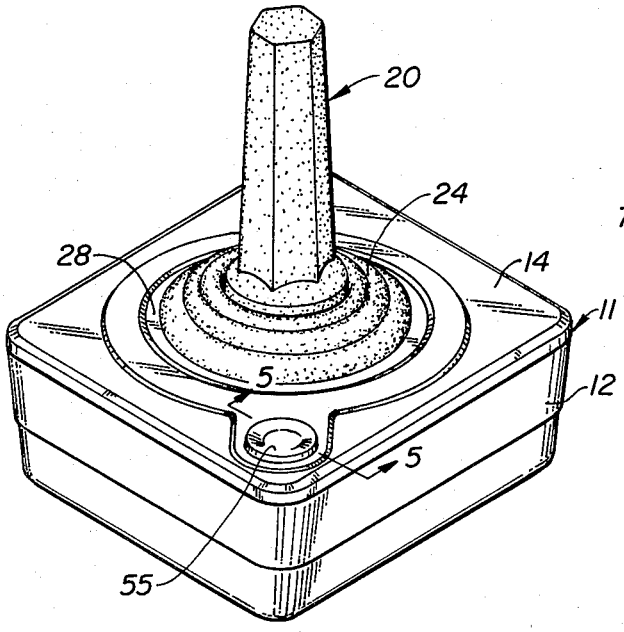
FIG. 4 is a perspective view of the joystick controller of FIG. 1 taken from a different perspective to show the firing button.
Figure 5:
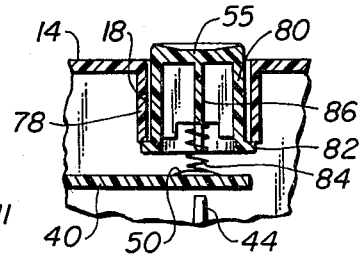
FIG. 5 is a fragmentary sectional view taken along lines 5—5 of FIG. 4.

Firing button 55 is illustrated by way of reference to FIGS. 4 and 5 in combination. An integrally molded sleeve 78 depends from aperture 18 in cover plate 14. Button 55 has a cylindrical portion 80 slideable within the sleeve, and a circumferential boss 82 which limits upward movement of the button. A coil spring 84 biases button 55 upwardly so that boss 82 normally abuts the bottom of sleeve 78 and the top portion of the button projects above cover plate 14. A pin 86 depends from the center of button 55 and engages dome switch 50 when the button is manually depressed.

In operation, controller 10 provides total control over an object, typically in a game such as a video game. The operator simply manipulates handle 20 in the direction in which it wants the object to move. The switches are disposed in logical coordinates corresponding to movement of the figure, e.g., forward movement of the handle closes the switch which moves the object upwardly. Combined movements can be accomplished by moving the handle in a nonorthogonal direction to close two switches simultaneously. If the object performs a function, such as a tank firing a shell, button 55 controls such operation. In short, controller 10 provides a relatively simple and straightforward control unit, which is easy to use by the player of a video game.

While a preferred embodiment of the present invention has been illustrated in detail, it is apparent that modifications and adaptations of that embodiment will occur to those skilled in the art. It is to be expressly understood, however, that such modifications and adaptations are within the spirit and scope of the present invention, as set forth in the following claims:

What is claimed is:

1. A joystick controller for selectively generating switch closures comprising;

an elongate handle moveable radially with respect to its axis about an axial pivot location from a nominal rest position;

a plurality of pressure-actuated switches disposed in a common plane normal to the axis of the handle in its rest position and circumscribing the axis of the handle in its rest position; and a deformable resilient annular member superimposed over the switches, said annular member being attached to the handle at spaced locations intermediate the respective locations of the switches so that displacement of the handle from its rest position causes an arcuate portion of the annular member to be pressed against and actuate at least one of the switches.

2. A controller as recited in claim 1 and additionally comprising a post having an axis coincident with the axis of the handle in its rest position, and wherein the handle includes a cup-shaped receptacle at one end thereof which engages the post so that the handle is movable radially with respect to its axis from its nominal rest position.

3. A joystick controller for selectively generating switch closures comprising:

a support post;

an elongate handle having a lower end including a cup shaped portion engaged by the support post so that the elongate handle is moveable about the post radially with respect to the axis of the handle from a nominal rest position, the lower end of said handle further including a portion having a circular outer periphery in a plane normal to the axis of the handle;

a plurality of pressure-actuated switches disposed in a common plane normal to the axis of the handle in its rest position and circumscribing the axis of the handle in its rest position; and a deformable resilient annular member superimposed over the switches, said annular member being attached to the circular portion of the handle at spaced apart locations between the respective switches, so that displacement of the handle from its rest position causes an arcuate portion of the annular member to be pressed against and actuate at least one of the switches.

4. A controller as recited in claim 1 or 3 and additionally comprising a cover member and a plurality of studs depending from said cover member and disposed above the annular member between the respective attachment points so that the movement of the annular member away from the position of a stud biases that portion of the annular member proximate a different stud toward its associated switch to minimize permanent deformation of the annular member.

5. A controller as recited in claim 1 or 3 wherein the switches include a central depression, and wherein the annular member includes a plurality of depending projections overlying the respective switches and adapted to mate with the depressions therein to facilitate actuation of the switches through movement of the annular member.

6. A joystick controller for selectively generating switch closures comprising:

an elongate handle moveable radially with respect to its axis about an axial pivot location from a nominal rest position;

a plurality of pressure-actuated switches disposed in a common plane normal to the axis of the handle in its rest position and circumscribing the axis of the handle in its rest position, each said switch including a central depression;

a deformable resilient annular member superimposed over the switches and including depending projections adapted to mate with the depressions in the respective switches, said annular member being attached to the handle at spaced apart locations between the respective switches; and a cover member having a plurality of studs disposed above the annular member between the respective attachment locations so that displacement of the handle from its rest position causes the projection or projections on an arcuate portion of the annular member to be pressed against and actuate at least one of the switches, while a separate distant arcuate portion is engaged by one of the studs and deformed toward its associated switch to minimize permanent deformation of the annular member.

7. A controller as recited in claim 1, 3 or 6 wherein the annular member is constructed of polypropylene.

8. A controller as recited in claim 1, 3 or 6 wherein the switches comprise four switches disposed orthogonally about the axis of the handle.

9. A controller as recited in claim 1, 3 or 6 and additionally comprising a substrate, said switches being disposed on said substrate.

10. The controller as recited in claim 9 wherein the substrate has a plurality of holes formed therein, and additionally comprising a plurality of tapered pegs depending from said cover member and adapted to mate with and engage the respective holes in the substrate to align the substrate precisely in a preselected position.

11. A controller as recited in claim 1, 3 or 6 and additionally comprising a flexible boot circumscribing and attached to the handle, and means for confining the outer circumference of the boot, said boot serving to maintain the handle in its nominal rest position until the handle is actuated.

12. A controller as recited in claim 6 wherein the post includes a plurality of circumferentially disposed supports to add structural rigidity to the post.

13. A control unit for a game such as a video game comprising:

a generally enclosed housing including an upper exposed surface having a central major aperture and a minor aperture offset from the central major aperture, said housing including a sleeve depending from the minor aperture;

a firing button projecting above the exposed surface of the housing until actuated and having a cylindrical portion slidable in the sleeve;

an elongate handle projecting upwardly through the major aperture in the housing, said handle having a cup-shaped receptacle at its lower end;

a support post within the housing and engaging the receptacle of the handle so that the handle is movable about the post radially with respect to the axis of the handle;

a resilient boot circumscribing and attached to the handle;

means for attaching the outer periphery of the boot to the housing so that the resilient boot tends to center the handle in a nominal rest position;

a substrate located within the housing and containing a plurality of pressure-actuated switches, one of said switches located beneath the firing button and adapted to be activated thereby, other of said switches being disposed circumferentially about the axis of the handle in its rest position; and a deformable resilient annular member superimposed over the switches disposed circumferentially about the axis of the handle, said annular member being attached to the handle so that displacement of the handle from its rest position causes an arcuate portion of the annular member to be pressed against and actuate at least one of the switches.

14. A control unit as recited in claim 13 wherein the housing has a circumferential recess about the major aperture, wherein the outer periphery of the resilient boot fits into said recess; and wherein said attaching means comprises a retainer ring engaged by said recess to retain the outer periphery of the boot therein.

15. A control unit as recited in claim 13 wherein the annular member is attached to the handle at spaced apart locations intermediate the respective locations of the switches.

16. A control unit as recited in claim 15 wherein the housing includes a plurality of depending studs having lower extremities disposed above the annular member between the respective attachment points so that movement of the annular member away from the position of a stud biases that portion of the annular member proximate a different stud toward its associated switch to minimize permanent deformation of the annular member.

17. A control unit as recited in claim 13 wherein the substrate has a plurality of holes formed therein, and wherein the housing includes a plurality of tapered pegs adapted to mate with and engage the respective holes in the substrate to align the substrate precisely in a preselected position.

18. A control unit as recited in claim 13 wherein the switches include a central depression, and wherein the annular member includes a plurality of depending projections overlying their respective switches and adapted to mate with the depressions therein to facilitate actuation of the switches through movement of the annular member.

* * * * *